US005248913A

United States Patent [19]

Heider

[11] Patent Number: 5,248,913

[45] Date of Patent: Sep. 28, 1993

[54] HIGH PRESSURE DISCHARGE LAMP

[75] Inventor: Jürgen Heider, Munich, Fed. Rep. of Germany

[73] Assignee: Patent-Treuhand-Gesellschaft für elektrische Glühlampen m.b.H., Munich, Fed. Rep. of Germany

[21] Appl. No.: 661,505

[22] Filed: Feb. 26, 1991

[30] Foreign Application Priority Data

Mar. 15, 1990 [DE] Fed. Rep. of Germany ... 9002959[U]

[51] Int. Cl.[5] ..... H01J 61/34; H01J 61/24

[52] U.S. Cl. ..... 313/25; 313/626; 313/639

[58] Field of Search ..... 313/25, 626, 639, 239

[56] References Cited

U.S. PATENT DOCUMENTS

| | | | |
|---|---|---|---|
| 2,009,221 | 7/1935 | Bruijnes et al. . | |
| 3,780,331 | 12/1973 | Knochel et al. | 313/626 |
| 4,734,612 | 3/1988 | Sasaki et al. | 313/15 |
| 4,843,266 | 6/1989 | Szanto et al. | 313/25 |
| 5,064,395 | 11/1991 | Kling et al. | 313/25 |

FOREIGN PATENT DOCUMENTS

| | | | |
|---|---|---|---|
| 3735523 | 4/1988 | Fed. Rep. of Germany . | |
| 55-143773 | 11/1980 | Japan . | |
| 57-138771 | 8/1982 | Japan . | |
| 1186632 | 4/1970 | United Kingdom | 313/626 |
| 1223955 | 3/1971 | United Kingdom . | |

*Primary Examiner*—Donald J. Yusko
*Assistant Examiner*—N. D. Patel
*Attorney, Agent, or Firm*—Frishauf, Holtz, Goodman & Woodward

[57] ABSTRACT

To prevent ion migration from a discharge vessel (4) into an evacuated space between the discharge vessel and an outer bulb (1), a shield wire (13) is interposed between the current supply lead (12) extending longitudinally within the outer bulb and the discharge vessel (4), and both the shield wire (13) and the current supply (12) are insulated by a high dielectric insulating material. A suitable material is a ceramic, like $Al_2O_3$ or $Ba_2TiO_4$, for example, as a single ceramic body with ducts for, respectively, the current supply lead (12) and the shielding wire (13), or, alternatively, to form separate ceramic sleeves (17, 18).

16 Claims, 2 Drawing Sheets

HIGH PRESSURE DISCHARGE LAMP

FIELD OF THE INVENTION

The present invention relates to a high pressure discharge lamp and more particularly to such a lamp which has a fill of an inert gas, mercury, and a metal halide, and contains an internal structure designed to reduce deterioration, during its life, due to ion migration.

BACKGROUND

High pressure discharge lamps which contain a fill which includes metals generate, in operation, positive metallic ions, see the referenced British patent 1,233,955. These positive metal ions may diffuse through the wall of the discharge vessel. If current carrying leads are located in the vicinity of the discharge vessel, the electrical field which is generated enhances ion migration in operation of the lamp. The electrical field also draws photoelectronsout of the vessel, which photoelectrons are generated by ultraviolet (UV) radiation during a discharge within the discharge vessel. The photoelectrons face toward the wall of the discharge vessel and enhance ion migration. The diffusion process leads to losses of the metallic fill additives, and, thus, the composition of the fill will change and result, eventually, in unstable behavior of the discharge arc within the high pressure discharge lamp.

Migration of ions occurs in many lamps, but particularly in high pressure discharge lamps which have discharge vessels made of quartz glass and which have metal halide additives in the fill. In operation, and due to the discharge, metal ions having a small ion radius, such as, for example, sodium ions will be generated. During operation of the lamp the external electrical fields enhance migration of the positively charged sodium ions through the wall of the vessel. The results will be that an excess of halide, particularly iodine, will remain within the discharge vessel. The excess iodine has electronegative behavior. This results in difficulties in igniting the discharge lamp, and raises the operating voltage of the arc tube.

The aforementioned referenced British patent 1,223,955 teaches the use of a shielding electrode in order to solve these problems. Merely placing a shielding electrode into the lamp, however, raises another problem namely that of electric arc-over between the shielding electrode and the current supply leads which extends parallel thereto. The outer bulb, in accordance with the British patent, can be filled with an inert gas which may have additives therein which are electronegative in order to decrease the average or median free path length of the photoelectrons.

It has been found, in operation, that electric arc-over between the shielding wire and the parallel current supply leads cannot be reliably prevented. Filling the outer bulb with a gas decreases the heat insulation of the discharge vessel. Further, the shielding wire, necessarily, is self supporting and free in space. Upon vibration, the shielding wire may deflect or oscillate, and hit against the current supply lead or against the discharge vessel, causing damage thereto, or even destruction thereof.

The referenced U.S. Pat. No. 4,843,266 describes a single-ended discharge lamp having an outer bulb and an axially located double-ended discharge vessel in which the current supply lead extending to the end remote from the base is insulated, for example, being retained within a glass sleeve. This lamp does not have a shielding electrode, and the insulating cover for the current supply lead does not have any shielding function with respect to the electrical field, or to inhibit migration of the ions which are generated due to the discharge. Ion migration is somewhat reduced, but not suppressed or inhibited to the extent desired.

THE INVENTION

It is an object to provide a discharge lamp which has satisfactory ignition behavior, an effectively constant operating voltage of the arc throughout its life and, overall, improved characteristics throughout lamp life by decreasing ion migration.

Briefly, both the current supply lead as well as an essentially parallel extending shield wire, are insulated with a high dielectric insulating material, for example aluminum oxide, $Ba_2TiO_4$ or the like; the high dielectric insulator may be a longitudinally extending ceramic element formed with two elongated openings through which, respectively, the electrode and the shield wire are guided. The shield wire is connected to a lamp electrode other than the one which is immediately adjacent thereto, in other words, full power supply voltage is applied across the dielectric between the electrode lead and the shield wire.

The arrangement, in accordance with the present invention, has the advantage that the electrical field which enhances ion migration is effectively shielded and that the insulating material of high dielectric constant effectively prevents arc-overs or short-circuits; further, the electrically insulating material of high dielectric constant decreases the electrical field which, otherwise, would enhance ion migration.

Surrounding both shield wire as well as current supply lead with a high dielectric insulating material also prevents charge accumulation at the wall of the discharge vessel with negative charges derived from photoelectrons. The insulating material reduces the effect of UV radiation which contributes to the photo effect; since the material, typically ceramic as aforesaid, is effectively blocking passage of photoelectrons, they are directed back towards the electrical conductor, from where they can be drained.

The present invention permits a particularly advantageous construction, namely to evacuate the outer bulb, since a fill gas is not needed. The fill gas does decrease the median free path length of the photoelectrons, but also substantially lowers the thermal insulation of the discharge vessel.

Using a common ceramic sleeve with respective openings for the current supply and for the shield wire, in accordance with a feature of the invention, permits a space saving arrangement without danger of electrical arc over between the respective oppositely polarized electrically conductive elements. A common ceramic sleeve further provides a mechanically stabilizing cover for the shielding element which, typically, is merely a wire.

High pressure discharge lamps constructed in accordance with the present invention have stable arc operative behavior and hence a longer life time than prior art high pressure discharge lamps. The discharge vessel itself may be made of quartz glass, or a light transparent ceramic material.

The present invention is particularly useful in high pressure discharge lamps which have fills which, in operation, liberate ion, such as sodium and/or lithium ions.

DRAWINGS

Figure 3A:
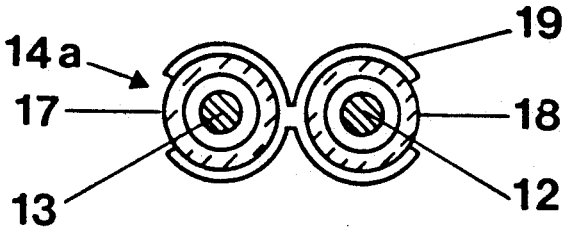
Figure 3B:
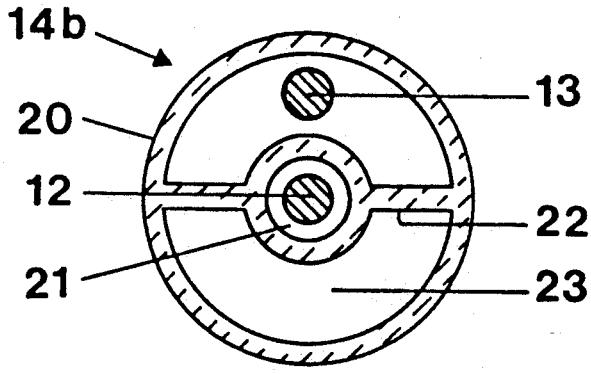
Figure 3C:
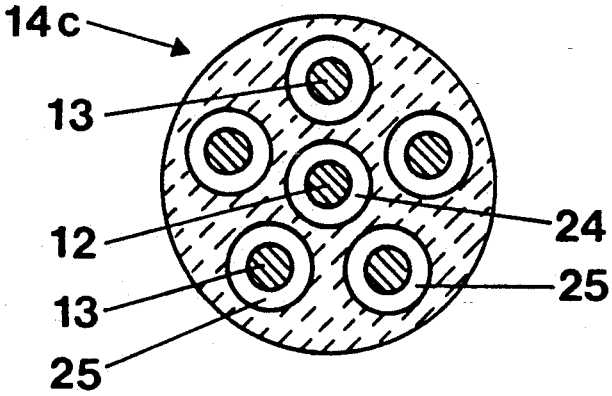

FIGS. 3*a*–3*c* are schematic cross-sectional views through alternate embodiments of shielding sleeves.

DETAILED DESCRIPTION

Figure 1A:
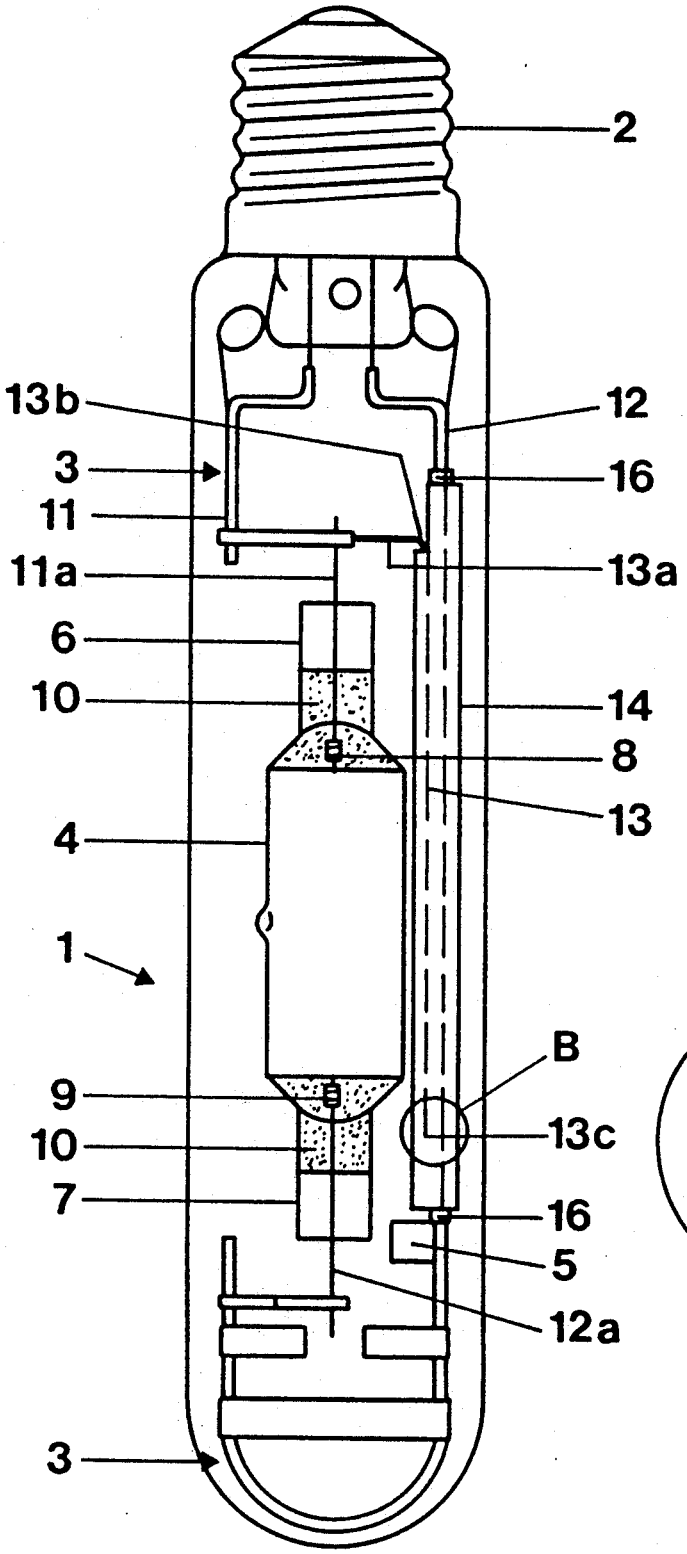
FIG. 1A is a side view of an embodiment of a high pressure discharge lamp, in which a shielding wire and a current supply lead are retained within a common insulating housing.
Figure 1B:
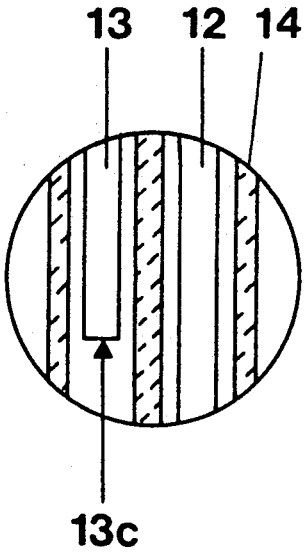
FIG. 1B is an enlarged fragmentary view of the portion within the circle B of FIG. 1A.

A 250 W metal halide discharge lamp, shown in FIG. 1, has an evacuated outer bulb 1 with a base 2. A holder frame 3 is located within the bulb 1 to hold a discharge vessel 4. The holder frame 3 also retains a getter 5. A discharge vessel 4 is axially positioned within the bulb 1. It has one end 6 close to the base 2, a remote end 7 at the outer end, remote from the base 2, and electrodes 8 and 9 which extend outwardly of the discharge vessel. The discharge vessel contains a fill of a noble gas and mercury, with additives of at least one of, or all of NaJ, $DyJ_3$, $HoJ_3$, $TmJ_3$ and TIJ. The ends 6, 7 of the discharge vessel have coatings 10 of a heat insulative material. A first current supply lead 11 extends towards the end 6 of the discharge vessel; it is coupled via an electrode connection 11*a* to the electrode 8. The second current supply lead 12 extends parallel to the discharge vessel 4, outside thereof and in the space between the discharge vessel 4 and the outer bulb 1. The current supply lead 12 is connected via a lead 12*a* to the electrode 9 at the remote end 7. A shielding wire 13 extends parallel to the current supply lead 12. The shielding wire 13 has a bent point 13*b*, an angled-over region 13*a* and, at its remote end, a terminal portion 13*c*. The bent-over or angled-over region 13*a* of the shield wire 13 is coupled to the first current supply lead 11 and electrically connected thereto.

In accordance with the feature of the invention, both the shield wire 13 as well as the current supply 12 are insulated and surrounded, at least in their major parts, by a ceramic element 14, made, for example, of $Al_2O_3$. The ceramic element 14 is a single unitary body, extending beyond the remote end 13*c* of the shield wire 13 up to a remote portion of the current supply lead 12, and beyond the remote end of the discharge vessel 1 itself. At the other end, the ceramic body 14 extends beyond the bend 13*b* of the shield wire 13, and towards the base 2, continuing to surround the current supply lead 12. Extending the body 14 beyond the end 13*c* of the shield wire at the one end, and beyond the outlet portion at the bend 13*b* has the advantage that electrical arc-over between the shield wire 13, which is connected to the current supply lead 11, and the current supply lead 12 is reliably and effectively prevented. The field strength between those two, oppositely charged electrical conductors is particularly high at sharp corners or ends. The ceramic body 14 is secured in position by collars or ferrules or tightening bands 16, for example of nickel, and tightened or connected to the second current supply lead 12. The body 14, thus, is held in mechanically stable position and, additionally, gives mechanical stability and strength to the shield wire 13.

Figure 2:
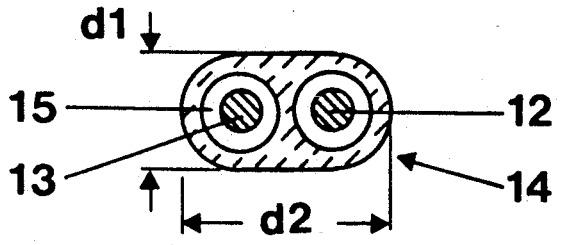
FIG. 2 is a cross-section through the ceramic sleeve shown in FIG. 1.

FIG. 2 is a schematic cross-section through the ceramic body 14. It has two longitudinal ducts 15, formed as straight bores. The smaller dimension d 1 of body 14 is, for example, 2.2 mm, the larger dimension D2 4.2 mm. The ducts 15, each, have a diameter of 1.2 mm.

Various changes and modifications may be made. FIG. 3*a* illustrates a ceramic body 14*a* which is formed as two separate tubes 17, 18, retained together by clamps 19 surrounding the tubes 17 and 18, as seen in FIG. 3*a*. The tubes 17, 18, retain, respectively, the shield wire 13 and the current supply lead 12. Preferably, two such clamps 19 are used, one each located near an end portion of the respective tubes, for example at the location of the circle B in FIG. 1A and in line with, or beyond the heat damming shield 10 of the arc tube 1.

Another embodiment is illustrated in FIG. 3*b*, where a circular ceramic element 14*b* is formed of two co-axial longitudinal tubular elements 20, 21. Ribs 22 hold the inner tube 21 in spaced position within the outer tube 20. The second current supply lead 12 is located within the central tube 21, and the shield wire 13 is positioned in the space between the central tube 21 and the outer tube 20. This embodiment permits various configurations for the shield wire 13; for example, the shield wire 13 may be a multi-strand element, in which the strands are spread throughout the space between the two tubes 20, 21. The strands are joined together, for example at the outside of the tube 20, or just the end thereof, and adjacent or at the bend or corner 13*b* (FIG. 1).

FIG. 3*c* illustrates another embodiment in which the ceramic body 14*c* is formed with a central duct 24 and five outer ducts 25, circumferentially located about the central duct 24. The second current supply lead 12 is positioned in the central duct 24. Each one of the ducts 25 retain at least one strand of the shielding wire 13. The strands of the shielding wire 13 are joined together outside of the ceramic body 14, in the vicinity of the corner or junction 13*b*.

Various changes modifications may be made and any features described herein may be used with any of the others, or any of the other embodiments within the scope of the inventive concept.

I claim:

1. A single-ended high-pressure discharge lamp having an outer bulb (1) having a base (2) at one end thereof;

a discharge vessel (4) located within the outer bulb, said discharge vessel having a base end (6) adjacent the base, and a remote end (7) remote from said base;

a fill of an inert gas, mercury and a metal containing an additive within the discharge vessel;

electrodes (8, 9) located within the discharge vessel;

electrode leads (11, 12*a*) extending outwardly of the discharge vessel, respectively, at said base end (6) and the remote end (7); and a connection frame structure (3) including a first current supply lead (11) coupled to one (11*a*) of said electrode leads, a second current supply lead (12) coupled to the other (12*a*) of the electrode leads, and a strip-like or wire-like elongated electrically conductive shielding element (13) extending parallel to the said second current supply lead (12), being insulated therefrom, and having an electrical potential applied thereto which differs from the electrical potential of the second current supply lead (12), the lamp further comprising a unitary ceramic body (14) formed with two longitudinal openings in which said second current supply lead (12) and said shielding element (13) are, respectively, placed, said unitary ceramic body (14) essentially consisting of at least one of: $Al_2O_3$; $Ba_2TiO_4$; and wherein the interior of the outer bulb (1) is evacuated.

2. The lamp of claim 1 wherein said shielding element (13) comprises an essentially straight portion, extending parallel to the second current supply lead (12) and an angled-over portion (13*a*) electrically connected to the first current supply lead (11).

3. The lamp of claim 1 wherein said shielding element comprises an essentially straight portion, extending parallel to the second current supply lead (12) and an angled-over portion (13*a*) electrically connected to the first current supply lead (11); and wherein said ceramic body (14) extends at least over the entire portion of the shielding element which is parallel to said second current supply lead (12).

4. The lamp of claim 3 wherein said ceramic body (14) extends beyond the terminal portion of the shielding element (13) at the remote end (13*c*) thereof.

5. The lamp of claim 3 wherein said angled-over portion (13*a*) of the shielding element (13) forms a bend or corner (13*b*) with the essentially parallel portion; and wherein the ceramic body (14) extends beyond said bend or corner.

6. The lamp of claim 3, wherein said shielding element comprises a multi-strand wire.

7. The lamp of claim 1, wherein said ceramic body comprises a unitary element and said longitudinal openings comprise a first duct means (15, 21) for retaining said second current supply lead (12) and a second duct means (15, 23) for retaining said shielding element (13), and a separating rib (22) in said unitary element for separating said duct means from each other.

8. The lamp of claim 7, wherein said shielding element comprises a multi-strand wire.

9. The lamp of claim 1, wherein said shielding element comprises a multi-strand wire.

10. A single-ended high-pressure discharge lamp having an outer bulb (1) having a base (2) at one end thereof;

a discharge vessel (4) located within the outer bulb, said discharge vessel having a base end (6) adjacent the base, and a remote end (7) remote from said base;

a fill of an inert gas, mercury and a metal containing an additive within the discharge vessel;

electrodes (8, 9) located within the discharge vessel;

electrode leads (11, 12*a*) extending outwardly of the discharge vessel, respectively, at said base end (6) and the remote end (7); and a connection frame structure (3) including a first current supply lead (11) coupled to one (11*a*) of said electrode leads, a second current supply lead (12) coupled to the other (12*a*) of the electrode leads, and a strip-like or wire-like elongated electrically conductive shielding element (13) extending parallel to the said second current supply lead (12), being insulated therefrom, and having an electrical potential applied thereto which differs from the electrical potential of the second current supply lead (12), the lamp further comprising two tubular cover elements (17, 18), each, retaining, respectively, said current supply lead (12) and said shielding element (13);

means (19) for mechanically coupling said tubular cover elements closely adjacent each other, said tubular elements comprising ceramic tubes or sleeves essentially consisting of at least one of: $Al_2O_3$; $Ba_2TiO_4$; and wherein the interior of the outer bulb (1) is evacuated.

11. The lamp of claim 10 wherein said shielding element (13) comprises an essentially straight portion, extending parallel to the second current supply lead (12) and an angled-over portion (13*a*) electrically connected to the first current supply lead (11).

12. The lamp of claim 10 wherein said shielding element comprises an essentially straight portion, extending parallel to the second current supply lead (12) and an angled-over portion (13*a*) electrically connected to the first current supply lead (11); and wherein said tubular cover elements (17, 18) extend at least over the entire portion of the shielding element which is parallel to said second current supply lead (12).

13. The lamp of claim 12, wherein said tubular cover elements (17, 18) extend beyond the terminal portion of the shielding element (13) at the remote end (13*c*) thereof.

14. The lamp of claim 12, wherein said angled-over portion (13*a*) of the shielding element (13) forms a bend or corner (13*b*) with the essentially parallel portion; and wherein the tubular cover elements (17, 18) extend beyond said bend or corner.

15. The lamp of claim 12, wherein said shielding element comprises a multi-strand wire.

16. The lamp of claim 10, wherein said shielding element comprises a multi-strand wire.

* * * * *